United States Patent [19]

Bahner

[11] 4,173,842

[45] Nov. 13, 1979

[54] FINGER PUPPET

[76] Inventor: Rodney D. Bahner, 2835 Will Rogers Pl., Anchorage, Ak. 99503

[21] Appl. No.: 850,751

[22] Filed: Nov. 11, 1977

[51] Int. Cl.[2] ..... A63H 3/00; A63H 3/14

[52] U.S. Cl. ..... 46/154

[58] Field of Search ..... 46/154, 126, 36, 37, 46/1 L; 36/10, 103, 104

[56] References Cited

U.S. PATENT DOCUMENTS

| | | | |
|---|---|---|---|
| 2,009,683 | 7/1935 | Wood | 46/154 X |
| 2,392,991 | 1/1946 | Macomber | 46/154 X |
| 2,420,986 | 5/1947 | Smith | 46/36 |
| 2,968,890 | 1/1961 | De Nisco | 46/179 |
| 3,226,849 | 1/1966 | Rosen | 46/154 X |
| 3,672,681 | 6/1972 | Wolf | 46/26 X |

*Primary Examiner*—F. Barry Shay

*Attorney, Agent, or Firm*—Knobbe, Martens, Olson, Hubbard & Bear

[57] ABSTRACT

A simple and inexpensive puppet is manufactured by the bonding of a pair of rigid, flat, relatively thin members, side by side, on a resilient backing member. When the rigid, flat members, which are originally mounted in a coplanar relationship by the resilient member, are articulated toward one another, the resilient backing tends to return these rigid members to a coplanar position. The puppet may thus be used by grasping the reverse side of the resilient portion between the thumb and index finger to urge the rigid portions to articulate toward one another. Releasing the pressure between the thumb and index finger allows the rigid members to articulate further away from one another. The puppet thus provides an articulating structure which may carry artwork or other indicia exemplifying a face or mouth so that, as it is manipulated between the thumb and index finger, the puppet appears to open and close its mouth.

7 Claims, 5 Drawing Figures

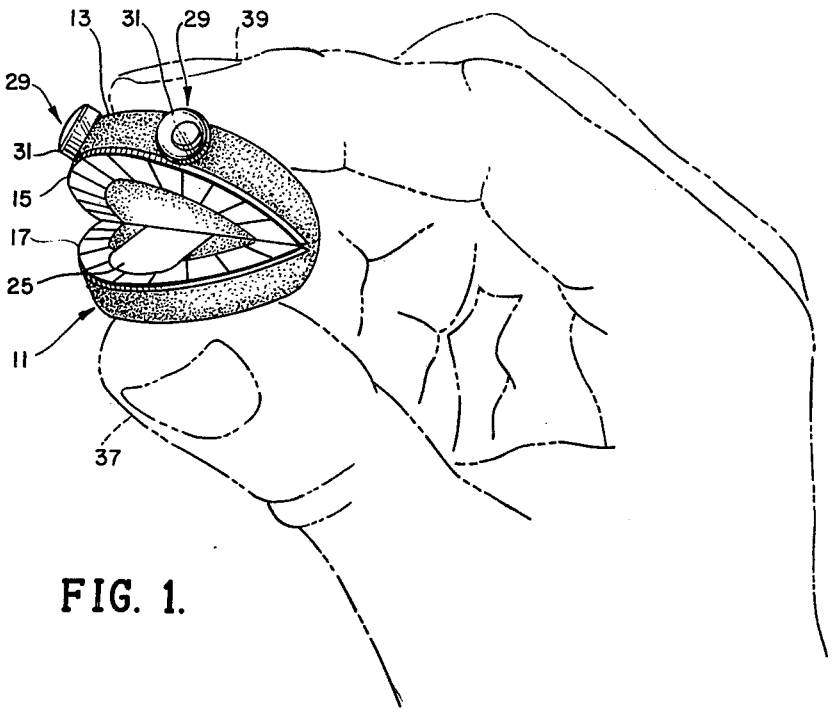
FIG. 1.
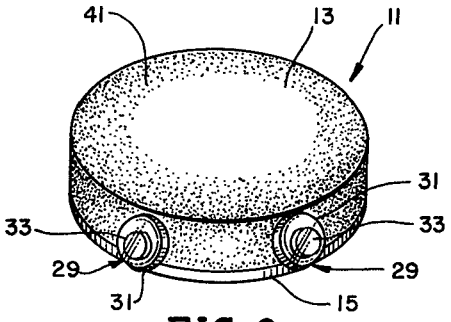
FIG. 2.
FIG. 4.
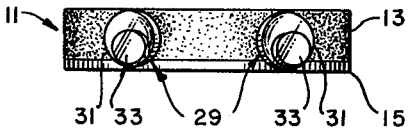
FIG. 3.
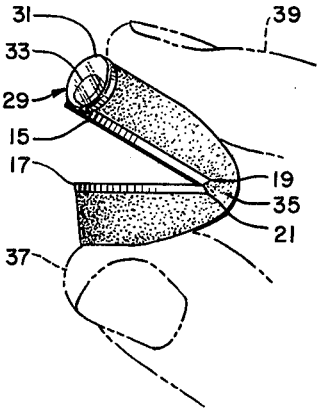
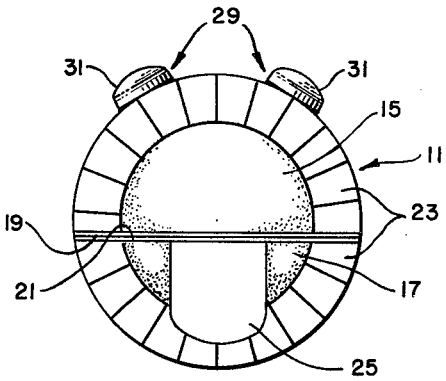
FIG. 5.

FINGER PUPPET

BACKGROUND OF THE INVENTION

This invention relates to puppets, and more specifically, to finger manipulated puppets.

The prior art has displayed a variety of puppet forms, the most common of which fits the entire hand of a user. Such puppets are generally rather expensive to construct, both because of the materials involved, the typical size of the puppets, and the complexity of their manufacture. This has limited the applicability of puppets for many applications, such as low-cost, high volume advertising use.

One of the primary difficulties with such hand puppets, that is, puppets in which the index and thumb of the user are manipulated to open and close the mouth of the puppet, is a typical requirement that the mouth be urged both toward an open and closed position with the index finger and thumb. This requires, in turn, some type of structure which encircles the hand, or at least the thumb and index finger of the user. These puppets also are relatively complex and thus relatively expensive to manufacture.

The prior art has not produced a puppet which is extremely inexpensive to manufacture, which is simple to manipulate, and which may be simply placed between the index finger and the thumb of the operator for manipulation without otherwise attaching it to the hand of the user.

SUMMARY OF THE PRESENT INVENTION

The present invention, on the other hand, provides an extremely inexpensive and simple finger puppet which may be mass produced in large numbers, as for advertising, promotional use. Using this invention, the cost of any one puppet may be extremely low. In addition, the puppet is easy to use and extremely convenient to grasp and release in the user's hand, such that no substantial delay is required at the beginning of use of the device.

These advantageous properties are accomplished through a unique construction of the device which includes a pair of relatively thin, rigid or semi-rigid jaw members, these jaw members typically including artwork such as teeth or a tongue to increase their appearance as the upper and lower jaws of the puppet. This pair of relatively flat, rigid members is mounted on a resilient backing material, as by adhesive, and are in a juxtaposed relationship along one edge. If, along this edge, the pair of relatively flat, rigid members are articulated toward one another, the abutting edge, together with the resilient backing member, form, in effect, a hinge about which articulation may occur. The flat members thus operate much like a double door with a hinge disposed between the door members, articulating about the abutting edges. The resilient member, during articulation, is caused to stretch, since the abutting edges of the flat members limit the degree of contraction permissible for the resilient member at the adhesive joint with the flat members. This stretching of the side or surface of the resilient member opposite the flat, rigid members causes a resilience in the entire puppet structure tending to force the puppet's mouth open.

If the back side of the resilient member is grasped between the thumb and forefinger of the user, the puppet can be articulated in a manner which forces the mouth to close. Since the mouth resiliently opens, the puppet is always urged against the index and forefinger of the user so that no additional means is required to hold the puppet between the fingers of the user during articulation of the puppet's mouth.

It will be recognized, of course, that even without abuttment of the relatively rigid, flat members, the resilience of the backing member may be sufficient to urge articulation of the mouth into an open configuration. This is particularly true if the resilient backing member is formed of foam having a thickness which is substantially greater than the thickness of the relatively rigid, flat members. A thin resilient member, however, may be used and will operate satisfactorily, especially if the rigid members abut during articulation.

The inherent resilience of the finger puppet of the present invention is extremely important, since it permits the puppet to self-bias toward an open position and thus allows the puppet to be simply grasped between the index finger and thumb of the user without otherwise being attached to the user's hand. The user can thus very conveniently pick up the puppet, place it between his thumb and index finger, and immediately begin using it. Furthermore, this self-biasing of the puppet, which makes it easy to use, also reduces the manufacturing cost, since the puppet, in its simplest form, can be manufactured as a simple resilient backing with a pair of attached flat, rigid members, and nothing more. The artwork on the inside of the puppet's mouth provides an illusion of personality for the puppet which may be enhanced, for example, with the inclusion of eyes on the outer rim of the rigid member or resilient member.

As will be seen, the puppet, because of its simple form, small size, and lack of body structure, forms an unusually attractive novelty device.

These and other advantages of the present invention are best understood through a reference to the drawings, in which:

FIG. 1 shows a perspective view of the finger puppet of the present invention being articulated between the thumb and index finger of a user;

FIG. 2 is a perspective view showing the back side and upper edge of the puppet of FIG. 1 before it is grasped and folded between the user's fingers;

FIG. 3 is a side elevation view showing the finger puppet of FIG. 1 being grasped by the index finger and thumb of the user;

FIG. 4 is an edge view of the puppet of FIG. 1 showing the relationship between the eyes thereof and the jaw portion; and FIG. 5 is a plan view showing the inside face of the puppet of FIG. 1 prior to being folded between the thumb and index finger of the user and showing the mouth indicia thereof.

DETAILED DESCRIPTION OF THE PREFERRED EMBODIMENT

Referring initially to FIGS. 2, 4, and 5, the puppet 11 of the present invention comprises a relatively thick, polymer foam backing sheet or wafer 13 which, in the preferred embodiment, is formed as a circular planar disk. In addition, the puppet includes a pair of relatively thinner, more rigid polymer or paper jaw members 15 and 17. The jaw members 15, 17 are sheet material which is attached to the foam sheet or pad 13 with an adhesive, such that the entire juxtaposed faces of these members are adhesively attached. The jaw members 15 and 17 are advantageously more rigid than is the foam wafer 13 so that, as will be described in more detail below, the puppet will be forced to fold when articulated along a straight line. The jaw members 15 and 17 meet at juxtaposed edges 19 and 21 which, in the preferred embodiment, extend along a diameter of the circular foam pad 13, so that the jaw members 15 and 17 are formed as semicircular, semi-rigid or rigid sheet portions.

While the jaw members 15 and 17 of the preferred embodiment are shown as separate members, separated at the edges 19 and 21, it will be recognized that the puppet may be formed with a single rigid sheet forming the jaw members, but in such instance, it is preferable that the sheet have a preferred fold line, which may be formed (in cardboard or plastic) by scoring the material during manufacture.

Alternatively, of course, it is possible to form the puppet of the present invention without a rigid sheet material on the foam 13 at all, so that the foam 13 forms the entire puppet. The construction which is shown, however, is preferred, since it forces the puppet to fold along a predetermined, exact straight line, which is much more difficult if foam alone is used. It will be recognized, however, that foam, if used alone, might be scored or otherwise formed to preferentially fold along a given line to simulate the device shown in the preferred embodiment. Additionally, it will be recognized by those skilled in the art, that it is possible to form the foam member 13 with one or two relatively rigid faces, as for example, by melting one face of the foam and allowing that face to harden into a more rigid substance that would be underlaid by an unhardened portion. Again, however, if the foam is to be used alone, it is preferable to form the material in a manner which provides a preferential fold line.

As particularly shown in FIG. 5, the jaw members 15 and 17 may conveniently include indicia depicting the inside of a mouth. Thus, in the example shown, indicia representing teeth 23 and a tongue 25 is formed on the jaw members 15 and 17 so that, when fully opened, as shown in FIG. 5, one face of the puppet appears to be the inside of the puppet's mouth.

In addition to the indicia 23 and 25, which help to form the appearance of a face and mouth, the puppet may conveniently include a pair of eyes 29 which may be formed, as is common in prior art dolls, with an outer transparent housing 31 and an inner opaque pupil member 33 which is free to move within the transparent housing 31.

Referring now to FIGS. 1 and 3, it can be seen that the separation of the jaw pieces 15 and 17 along the edges 19 and 21, in effect, forms a fold line for the entire puppet, such that the resilient pad 13 will preferentially fold at this point. When the puppet is to be used, it is grasped, as shown in FIGS. 1 and 3, and folded along the edges 19 and 21 to partially close the puppet's mouth, the jaw pieces 15 and 17 being articulated about the edges 19 and 21. During this articulation, as is best seen in FIG. 3, an elbow 35 is formed in the foam member 13, with the edges 21 and 19 abutting to force the elbow portion 35 to stretch around the point of articulation. This stretching at the elbow 35 permits the foam member 13 to resiliently bias the puppet toward an open-mouthed configuration. This permits the puppet to be held between the thumb 37 and index finger 39 of the user so that, by squeezing the puppet and releasing it, alternately, the user can make the puppet open and close its mouth. Because of the resilience at the elbow 35, the puppet tends to press against the thumb 37 and index finger 39, so that it does not slip from the user's hand. It is thus possible to manipulate the puppet 11 without any further attachment of the puppet to the user's hand.

It should be noted that the back surface 41 of the puppet 11 is advantageously formed as a soft resilient foam polymer surface which is easily gripped between the thumb 37 and index finger 39. This material is sufficiently soft that it is depressed by the fingers and this depression prohibits the puppet 11 from squirting, in effect, out of the user's hand when the puppet is partially opened, as shown in FIG. 1. Thus, even though there is a substantial amount of resilience in the puppet 11 tending to make the foam material resume a planar configuration, this resilience is not great enough to stop the user from manipulating the puppet, nor great enough to make the puppet jump out of the hand of the user. The soft back face 41 of the material 13 assists in this gripping action.

It has been found that, in addition to its obvious use as a novelty device or standard puppet, the device shown herein may be helpful in speech therapy as, for example, in assisting stuttering persons to speak. It has been found that when these persons speak through a puppet, their stuttering is often reduced or stops altogether. The puppet shown in the present application is a particularly convenient device for this purpose, since it is very small and easily carried from place to place, is attractive in appearance, and is extremely inexpensive to manufacture.

It has also been found that the puppet of this invention may be helpful as a physical therapy device in helping persons, particularly those with physical handicaps, in learning to manipulate the puppet between their finger and thumb.

It will be appreciated from the description given above that the puppet of the present invention is an extremely simple device, being manufactured by applying the jaw members 15 and 17, which are semi-rigid or rigid sheets, to the face of a resilient foam member 13. The artwork, of course, can be previously printed on the jaw members 15 and 17 and the eyes 29 may, if desired, be glued onto the foam 13 after assembly.

The sheet material which forms the jaw members 15 and 17 may be formed as a single piece or might, in some instances, be eliminated altogether. In such an instance, the foam 13 provides the entire structure for the puppet and may bear artwork directly on one face. Alternatively, as suggested above, one face of the foam 13 might be hardened, as by a melting operation.

The unique features of this puppet are its small size, which allows manipulation between the thumb and index finger of a user, and the simple manufacture and use of the device, the self-biasing of the resilient foam pad 13 allowing it to be manipulated between the user's fingers without other attachment to the user's fingers or hand.

What is claimed is:

1. A finger puppet, comprising:

a resilient sheet of material having a pair of rigid, planar jaws formed on one surface thereof and a relatively resilient and flexible portion formed adjacent to and underlying said one surface, said jaws delineated on said one surface by a substantially straight preferential fold line for said sheet; and said substantially straight preferential fold line of said pair of jaws being formed such that, when said sheet is folded about said preferential fold line in a manner to close said jaws, the rigidity of said jaws delineated by said fold line forces said resilient, flexible portion of said sheet to stretch across said fold line, thus self-biasing said puppet to an open position.

2. A hand-actuated puppet, comprising:

a wafer of flexible, resilient material;

a hard, flat, planar surface on one side of said wafer, said surface forming two adjoining segments delineated at a preferential fold line; and the other side of said wafer forming a second surface, which is soft relative to said hard surface, for gripping between a finger and the thumb of said hand to fold said wafer over on itself at said preferential fold line so as to place said segments in an overlying relation to one another, thereby defining a mouth for said puppet, and to stretch said resilient wafer around said preferential fold line to self-bias said puppet to an open mouth configuration.

3. A hand-actuated puppet, as defined in claim 2, additionally comprising:

indicia representing the inside of a mouth, said indicia located on said hard, flat planar surface of said wafer.

4. A hand-actuated puppet, as defined in claim 3, additionally comprising:

means representing eyes fixed to said wafer of flexible resilient material.

5. A hand-actuated puppet, as defined in claim 4, wherein said means representing eyes are fixed to one edge of said wafer of flexible resilient material.

6. A hand-actuated puppet, as defined in claim 2, wherein said hard, flat planar surface comprises two separate sheet members of relatively rigid material, each of said sheet members fixed to the same side of said wafer, said sheet members being juxtaposed to one another on said wafer.

7. A finger puppet, comprising:

a resilient backing sheet;

a pair of rigid, planar jaw members, both mounted on one face of said resilient backing sheet, said jaw members forming a substantially straight, preferential fold line for said backing sheet; and said substantially straight preferential fold line of said pair of jaw members being formed such that when said backing sheet is folded about said preferential fold line, said fold line forces said backing sheet to stretch, thus self-biasing said puppet to an open position.

* * * * *